US007425935B2

(12) United States Patent
Kim et al.

(10) Patent No.: US 7,425,935 B2
(45) Date of Patent: Sep. 16, 2008

(54) METHOD AND APPARATUS OF DRIVING A PLASMA DISPLAY PANEL

(75) Inventors: Young Dae Kim, Busan (KR); Soo Seok Sim, Gumi-si (KR)

(73) Assignee: LG Electronics, Inc., Seoul (KR)

( * ) Notice: Subject to any disclaimer, the term of this patent is extended or adjusted under 35 U.S.C. 154(b) by 765 days.

(21) Appl. No.: 10/963,601

(22) Filed: Oct. 14, 2004

(65) Prior Publication Data

US 2005/0104810 A1 May 19, 2005

(30) Foreign Application Priority Data

Oct. 14, 2003 (KR) ..... 10-2003-0071500

(51) Int. Cl.
*G09G 3/28* (2006.01)

(52) U.S. Cl. ..... 345/60; 345/61; 345/62; 345/63; 345/64; 345/37

(58) Field of Classification Search ..... 345/60–64, 345/37

See application file for complete search history.

(56) References Cited

U.S. PATENT DOCUMENTS

| | | | | |
|---|---|---|---|---|
| 6,337,673 | B1 | 1/2002 | Ide et al. | |
| 2001/0006379 | A1 | 7/2001 | Kasahara et al. | |
| 2003/0173903 | A1 | 9/2003 | Takeuchi et al. | |
| 2005/0035928 | A1 * | 2/2005 | De Greef | 345/60 |

* cited by examiner

*Primary Examiner*—Richard Hjerpe
*Assistant Examiner*—Leonid Shapiro
(74) *Attorney, Agent, or Firm*—McKenna Long & Aldridge LLP

(57) ABSTRACT

An apparagraph and method of driving a plasma display panel that enables the display of an image wherein contour noise is minimized and that prevents flickering mal-discharge and mis-discharge when the plasma display panel is being driven at high/low temperature is provided. The method includes detecting a drive temperature of a panel, mapping data using a first sub-field pattern mapping when the panel is driven at a low temperature or a high temperature, and mapping the data using a second sub-field pattern mapping different from the first sub-field pattern mapping when the panel is driven at a temperature between the low temperature and the high temperature.

13 Claims, 6 Drawing Sheets

| Drive condition | Display gray level | 1st mapping | 2nd mapping |
|---|---|---|---|
| Normal drive temperature | 1 | 1 | 1 |
| | ⋮ | | |
| | 10 | 10 | 10 |
| | ⋮ | | |
| | 32 | 31 | 33 |
| | ⋮ | | |
| | 64 | 62 | 66 |
| | ⋮ | | |
| Low temperature & High temperature | 1 | 1 | 1 |
| | ⋮ | | |
| | 10 | 10 | 10 |
| | ⋮ | | |
| | 32 | 32 | 32 |
| | ⋮ | | |
| | 64 | 64 | 64 |
| | ⋮ | | |

Fig. 4

| Drive condition | Display gray level | 1st mapping | 2nd mapping |
|---|---|---|---|
| Normal drive tempe rature | 1 | 1 | 1 |
| | ⋮ | | |
| | 10 | 10 | 10 |
| | ⋮ | | |
| | 32 | 31 | 33 |
| | ⋮ | | |
| | 64 | 62 | 66 |
| | ⋮ | | |
| Low tempe rature & High tempe rature | 1 | 1 | 1 |
| | ⋮ | | |
| | 10 | 10 | 10 |
| | ⋮ | | |
| | 32 | 32 | 32 |
| | ⋮ | | |
| | 64 | 64 | 64 |
| | ⋮ | | |

METHOD AND APPARATUS OF DRIVING A PLASMA DISPLAY PANEL

This Nonprovisional application claims priority under 35 U.S.C. § 119(a) on Pat. Application No. 10-2003-0071500 filed in Korea on Oct. 14, 2003, the entire contents of which are hereby incorporated by reference.

BACKGROUND OF THE INVENTION

1. Field of the Invention

The present invention relates to a plasma display panel, and more particularly, to a method and an apparatus of driving a plasma display panel.

2. Description of the Background Art

Generally, a plasma display panel (hereinafter abbreviated PDP) displays an image including characters and graphics in a manner of exciting a fluorescent substance by a 147 nm UV-ray emitted from a mixed gas discharge of (He+Xe), (Ne+Xe), or (He+Ne+Xe). PDP displays provide excellent image quality with a slim size and wide-screen due to recent technology developments. Specifically, a 3-electrode AC surface discharge type PDP lowers the voltage necessary for an electric discharge using wall charges accumulated on a surface and protects its electrodes from sputtering that occurs on the electric discharge, thereby enabling low voltage drive and long endurance.

FIG. 1 is a perspective diagram of a discharge cell of a 3-electrode AC surface discharge type PDP according to a related art. Referring to FIG. 1, a discharge cell of a 3-electrode AC surface discharge type PDP consists of a scan electrode 30Y and sustain electrode 30Z formed on an upper substrate 10 and an address electrode 20X formed on a lower substrate 18.

Each of the scan and sustain electrodes 30Y and 30Z has a line width smaller than that of a transparent electrode 12Y or 12Z and includes a metal bus electrode 13Y or 13Z. The transparent electrodes 12Y and 12Z are generally formed of indium tin oxide (ITO) on the upper substrate 10. The metal bus electrodes 13Y and 13Z are generally formed of metal such as Cr or the like on the transparent electrodes 12Y and 12Z to reduce the voltage drops caused by the high resistance of the transparent electrodes 12Y and 12Z, respectively. An upper dielectric layer 14 and protecting layer 16 are stacked over the upper substrate 10 including the scan and sustain electrodes 30Y and 30Z. Wall charges generated from plasma discharge are accumulated on the upper dielectric layer 14. The protecting layer 16 protects the upper dielectric layer 14 against sputtering caused by plasma discharge and increases discharge efficiency of secondary electrons. And, the protecting layer 16 is generally formed of MgO.

The address electrode 20X is formed in a direction crossing with that of the scan or sustain electrode 30Y or 30Z. A lower dielectric layer 22 and barrier rib 24 are formed on the lower substrate 8 having the address electrode 20X formed thereon. A fluorescent layer 26 is formed on surfaces of the lower dielectric layer 22 and the barrier rib 24. The barrier rib 24 is formed parallel to the address electrode 20X to physically partition each discharge cell and prevents UV and visible rays generated from electric discharge from leaking to neighbor discharge cells. The fluorescent layer 26 is excited by the UV-ray generated from plasma discharge to emit light including one of red, green, and blue visible rays. A mixed inert gas such as He+Xe, Ne+Xe, He+Xe+Ne, and the like for electric discharge is injected in a discharge space of the discharge cell provided between the barrier ribs 24 and the upper and lower substrates 10 and 18.

In the above-configured 3-electrode AC surface discharge type PDP, one frame is divided into several sub-fields differing in luminous times to implement gray levels of an image. Each of the sub-fields is also divided into a reset period for arousing electric discharge evenly, an address period for selecting a discharge cell, and a sustain period for implementing gray levels according to a discharging number.

For instance, in case of displaying an image with 256 gray levels, a frame period (16.67 ms) corresponding to 1/60 second is divided into eight sub-fields SF1 To SF8. In addition, each of the eight sub-fields SF1 to SF8 is divided into a reset period, an address period, and a sustain period. The reset and address periods of the respective sub-fields are equal to each other, whereas the sustain periods and their discharge numbers of the respective sub-fields increase at a ratio of $2^n$ (n=0, 1, 2, 3, 4, 5, 6, 7), respectively. As the sustain period varies according to the corresponding sub-field, the image gray levels can be implemented.

Substantially, the sub-fields of the frame are selected to implement the gray levels in a manner of Table 1.

TABLE 1

| | SF1 Y1 | SF2 Y2 | SF3 Y3 | SF4 Y8 | SF5 Y16 | SF6 Y32 | SF7 Y64 | SF8 Y128 |
|---|---|---|---|---|---|---|---|---|
| 0 | X | X | X | X | X | X | X | X |
| 1 | ○ | X | X | X | X | X | X | X |
| 2 | X | ○ | X | X | X | X | X | X |
| 15 | ○ | ○ | ○ | ○ | X | X | X | X |
| 16 | X | X | X | X | ○ | X | X | X |
| 17 | ○ | X | X | X | ○ | X | X | X |
| . | | | | | | | | |
| . | | | | | | | | |
| . | | | | | | | | |
| 31 | ○ | ○ | ○ | ○ | ○ | X | X | X |
| 32 | X | X | X | X | X | ○ | X | X |
| 33 | ○ | X | X | X | X | ○ | X | X |
| . | | | | | | | | |
| . | | | | | | | | |
| . | | | | | | | | |
| 63 | ○ | ○ | ○ | ○ | ○ | ○ | X | X |
| 64 | X | X | X | X | X | X | ○ | X |
| . | | | | | | | | |
| . | | | | | | | | |
| . | | | | | | | | |
| 127 | ○ | ○ | ○ | ○ | ○ | ○ | ○ | X |
| 128 | X | X | X | X | X | X | X | ○ |
| . | | | | | | | | |
| . | | | | | | | | |
| . | | | | | | | | |
| 255 | ○ | ○ | ○ | ○ | ○ | ○ | ○ | ○ |

In Table 1, 'SFx' means an $x^{th}$ sub-field, 'Yz' indicates a brightness weight set to a decimal number for the corresponding sub-field, '602' indicates a turned-on state of the corresponding sub-field, and 'X' indicates a turned-off state of the corresponding sub-field.

The sub-fields, as shown in Table 1, bring about sustain discharges to correspond to the brightness weights allocated to them, respectively, thereby representing gray levels corresponding to the brightness weights, respectively.

Yet, the related art PDP brings about a problem that Contour Noise takes place by the discord between a light integration direction and a visual characteristic recognizable by human eyes between the gray levels 15-16, 31-32, 63-64, or 127-128 where a luminous pattern considerably varies. For instance, in case that the luminous pattern varies between the gray levels 128 and 127, a luminosity difference between the two frames becomes a value of '1'. Yet, if the gray value of '127' is displayed as shown in Table 1, the first to seventh sub-fields SF1 to SF7 become luminous. And, if the gray value of '128' is displayed as shown in Table 1, the eights sub-field SF8 becomes luminous. Namely, when the luminous pattern is changed from '128' to '127', a luminous pattern timing difference between the two frames becomes big to bring about a great movement of a luminous point, whereby Contour Noise occurs.

Meanwhile, in order to eliminate Contour Noise occurring in PDP, a method of displaying a gray level (16, 32, 64, 128), of which luminous pattern considerably changes, on the average has been proposed in the related art. In other words, gray levels of 'A (e.g., 31)' and 'B (e.g., 33)' are displayed in two neighbor discharge cells, as shown in FIG. 3, to represent a gray level of 'C. (e.g., 32) on the average. Thus, if the gray level having a greatly changeable pattern is displayed on the average using the gray levels displayed in the neighbor discharge cells, it is advantageous in reducing Contour Noise.

However, as mentioned in the above description, if the gray level having a greatly changeable pattern is displayed on the average, flickering mal-discharge and/or mis-discharge or the like occurs at low temperature of 15~(−)50° C. or high temperature of 50~100° C.

Specifically, the gray levels of 'A' and 'B' are displayed in the discharge cells adjacent to each other, as shown in FIG. 3, to minimize Contour Noise. In doing so, a discharge timing of the gray level of 'A' is mostly different from that of the gray level of 'B'. In other words, one discharge occurs in the first to fifth sub-fields SF1 To SF5 to display the gray level of 'A (31)'. And, the other discharge occurs in the first to sixth sub-fields SF1 To SF6 to display the gray level of 'B (32)'. In displaying the gray levels of 'A' and 'B', the discharges simultaneously occur in the first sub-field SF1 only but fail to occur simultaneously in the rest sub-fields. If the discharges of the neighbor discharge cells occur in the different timings, respectively, i.e., if priming charged particles are produced in the different timings, a specific discharge cell fails to be supplied with the produced priming charged particles when the discharge of the discharge cell adjacent to the specific one takes place. Hence, the flickering mal-discharge and/or discharge failure and the like are brought about at the low and/or high temperature.

In this case, a loss amount of wall charges produced during an initialization period increases as the motion of particles becomes active at the high temperature. Hence, mis-discharge and the like take place when the gray level, of which luminous pattern is greatly changed, is displayed on the average. And, since the particle motion slows down at the low temperature so that erase discharge and the like may fail to occur normally, it is difficult to produce the wall charges corresponding to a demanded amount during the initialization period. Hence, the flickering mal-discharge and the like take place in displaying the gray level having the considerably changeable luminous pattern on the average.

Meanwhile, in another related art, a method of raising brightness with a drive voltage higher than that of a low-density Xe panel by setting a component of Xe among discharge gas sealed within PDP to at least 5% of the discharge gas is proposed. Namely, a high-density Xe panel enables to display an image of high brightness by raising the Xe component of the discharge gas. Yet, since the drive voltage of the high-density Xe panel is set higher than that of the low-density Xe panel, it becomes more probable that the mis-discharge or discharge failure of the high-density Xe panel may occur at the low or high temperature in displaying the gray level having the greatly changeable luminous pattern on the average.

SUMMARY OF THE INVENTION

Accordingly, an object of the present invention is to solve at least the problems and disadvantages of the background art.

An object of the present invention is to provide a method of diving a plasma display panel and apparatus thereof, by which mis-discharge or mal-discharge can be prevented.

According to an embodiment of the present invention, a method of driving a plasma display panel which includes front and rear substrates confronting each other, a pair of transparent electrodes on a confronting surface of the front substrate, a metal electrode provided to each of the transparent electrodes, a dielectric layer covering the transparent and metal electrodes, a protecting layer coated on the dielectric layer, an address electrode formed on a confronting surface of the rear substrate, a dielectric layer covering the address electrode, a barrier rib formed on the dielectric layer, a discharge cell partitioned by the barrier rib, and a fluorescent layer coated within the discharge cell, includes a step of detecting a drive temperature of a panel, a step of mapping data using a first sub-field pattern mapping when the panel is driven at a low temperature or a high temperature, and a step of mapping the data using a second sub-field pattern mapping different from the first sub-field pattern mapping when the panel is driven at a temperature between the low temperature and the high temperature.

According to an embodiment of the present invention, an apparatus for driving a plasma display panel which includes front and rear substrates confronting each other, a pair of transparent electrodes on a confronting surface of the front substrate, a metal electrode provided to each of the transparent electrodes, a dielectric layer covering the transparent and metal electrodes, a protecting layer coated on the dielectric layer, an address electrode formed on a confronting surface of the rear substrate, a dielectric layer covering the address electrode, a barrier rib formed on the dielectric layer, a discharge cell partitioned by the barrier rib, and a fluorescent layer coated within the discharge cell, includes a temperature sensor detecting a drive temperature of a panel and a sub-field mapping unit setting up a pattern mapping scheme corresponding to the drive temperature detected by the temperature sensor.

The method of driving the plasma display panel and apparatus thereof according to the present invention enables the display of an image wherein contour noise is minimized by displaying a gray level, of which luminous pattern is greatly changed, on the average in driving a plasma display panel at a normal drive temperature. And, when the plasma display panel is being driven at high/low temperature, the method and apparatus according to the present invention prevents flickering mal-discharge and mis-discharge from occurring at the high/low temperature by displaying the entire gray levels as they are.

BRIEF DESCRIPTION OF THE DRAWINGS

The invention will be described in detail with reference to the following drawings in which like numerals refer to like elements.

FIG. 4 is a diagram of a method of driving a plasma display panel according to an embodiment of the present invention.

DETAILED DESCRIPTION OF PREFERRED EMBODIMENTS

Figure 1:
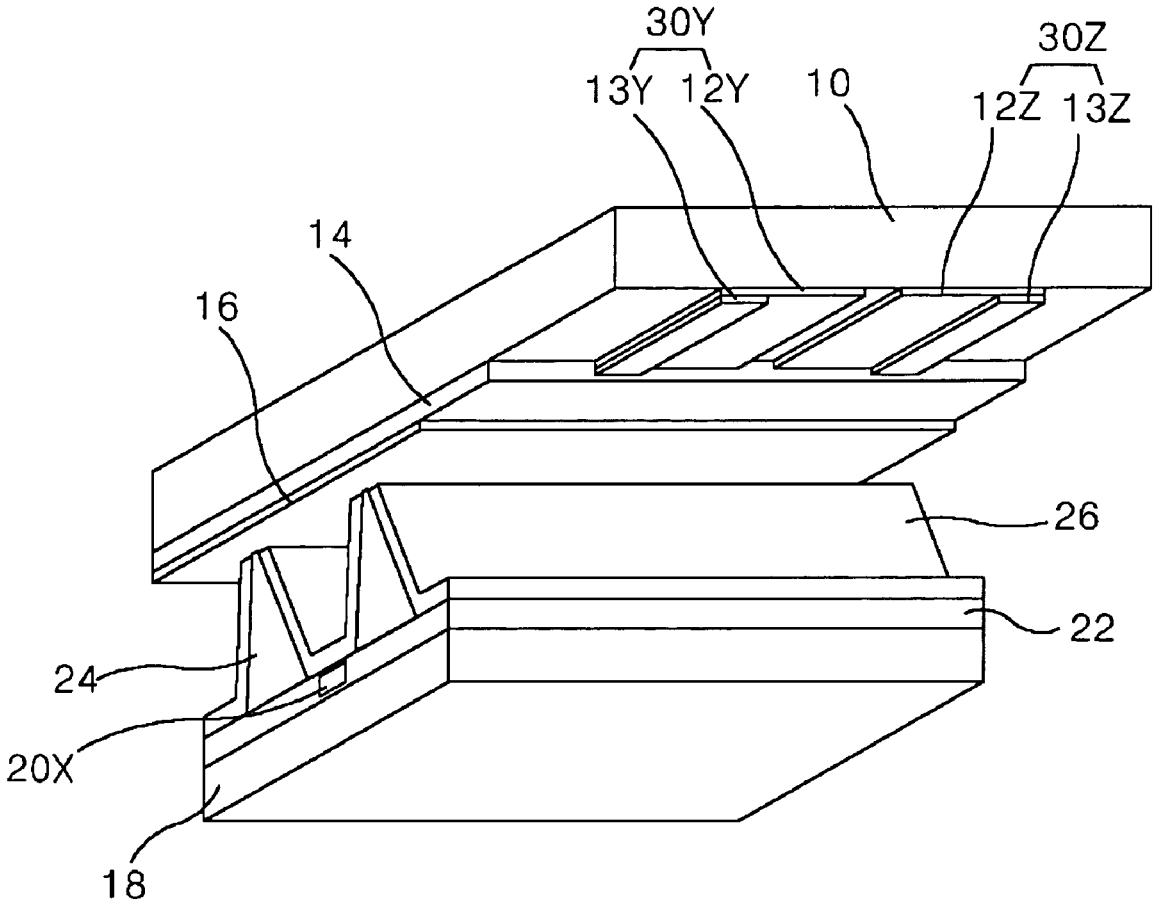
FIG. 1 is a perspective diagram of a discharge cell of a 3-electrode AC surface discharge type PDP according to a related art.
Figure 2:
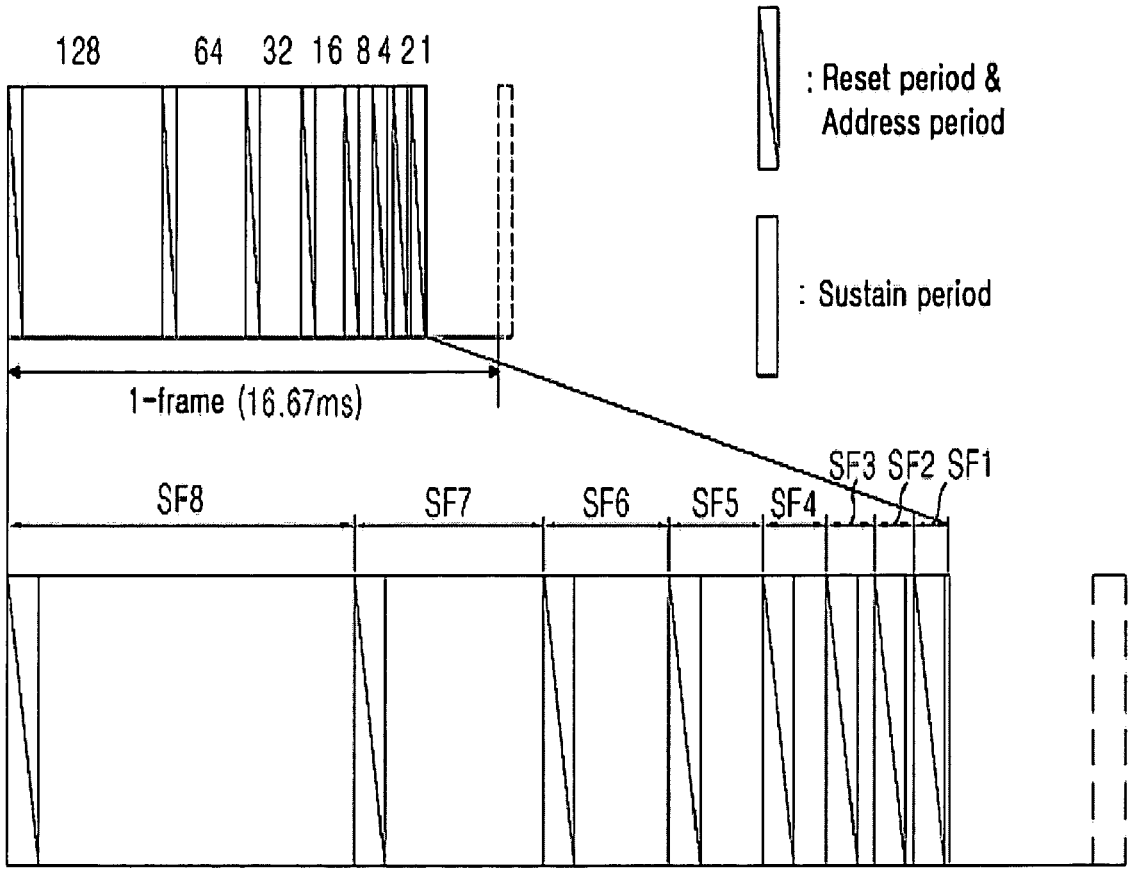
FIG. 2 is a timing diagram of a plurality of sub-fields included in one frame.

Preferred embodiments of the present invention will be described in a more detailed manner with reference to the drawings.

According to an embodiment of the present invention, a method of driving a plasma display panel which includes front and rear substrates confronting each other, a pair of transparent electrodes on a confronting surface of the front substrate, a metal electrode provided to each of the transparent electrodes, a dielectric layer covering the transparent and metal electrodes, a protecting layer coated on the dielectric layer, an address electrode formed on a confronting surface of the rear substrate, a dielectric layer covering the address electrode, a barrier rib formed on the dielectric layer, a discharge cell partitioned by the barrier rib, and a fluorescent layer coated within the discharge cell, includes a step of detecting a drive temperature of the panel, a step of mapping data using a first sub-field pattern mapping when the panel is driven at a low temperature or a high temperature, and a step of mapping the data using a second sub-field pattern mapping different from the first sub-field pattern mapping when the panel is driven at a temperature between the low temperature and the high temperature.

In displaying a gray level of which luminous pattern is greatly changed, the second sub-field pattern mapping is carried out in a manner of displaying the gray level, of which luminous pattern is greatly changed, on an average in adjacent discharge cells.

The first sub-field pattern mapping is carried out in a manner of displaying entire gray levels including the gray level, of which luminous pattern is greatly changed, as they are.

The low temperature ranges between 15~(−)50° C. and the high temperature ranges between 50~100° C.

And, a discharge gas including a Xe gas amounting to at least 5% thereof is provided within an inner space of the panel.

According to an embodiment of the present invention, an apparatus for driving a plasma display panel which includes front and rear substrates confronting each other, a pair of transparent electrodes on a confronting surface of the front substrate, a metal electrode provided to each of the transparent electrodes, a dielectric layer covering the transparent and metal electrodes, a protecting layer coated on the dielectric layer, an address electrode formed on a confronting surface of the rear substrate, a dielectric layer covering the address electrode, a barrier rib formed on the dielectric layer, a discharge cell partitioned by the barrier rib, and a fluorescent layer coated within the discharge cell, includes a temperature sensor detecting a drive temperature of a panel and a sub-field mapping unit setting up a pattern mapping scheme corresponding to the drive temperature detected by the temperature sensor.

The sub-field pattern mapping unit carries out mapping on data in a manner of displaying entire gray levels including the gray level, of which luminous pattern is greatly changed if the drive temperature detected by the temperature sensor corresponds to either a high temperature or a low temperature, as they are.

In displaying a gray level, of which luminous pattern is greatly changed if the drive temperature detected by the temperature sensor corresponds to either a high temperature or a low temperature, the sub-field pattern mapping unit carries out mapping on data in a manner of displaying the gray level on an average in adjacent discharge cells.

And, the low temperature ranges between 15~(−)50° C. and the high temperature ranges between 50~100° C.

Hereafter, the embodiments of the present invention will be described with reference to the drawings.

FIG. 4 is a diagram of a method of driving a plasma display panel according to an embodiment of the present invention.

Referring to FIG. 4, in a method of driving a plasma display panel (PDP) according to an embodiment of the present invention, a driving method at low/high temperature is set different from a sub-field pattern mapping method at a temperature (hereinafter called normal drive temperature) between the low and high temperatures. In doing so, a temperature sensor is attached to the PDP to monitor a drive temperature of the PDP.

Figure 3:
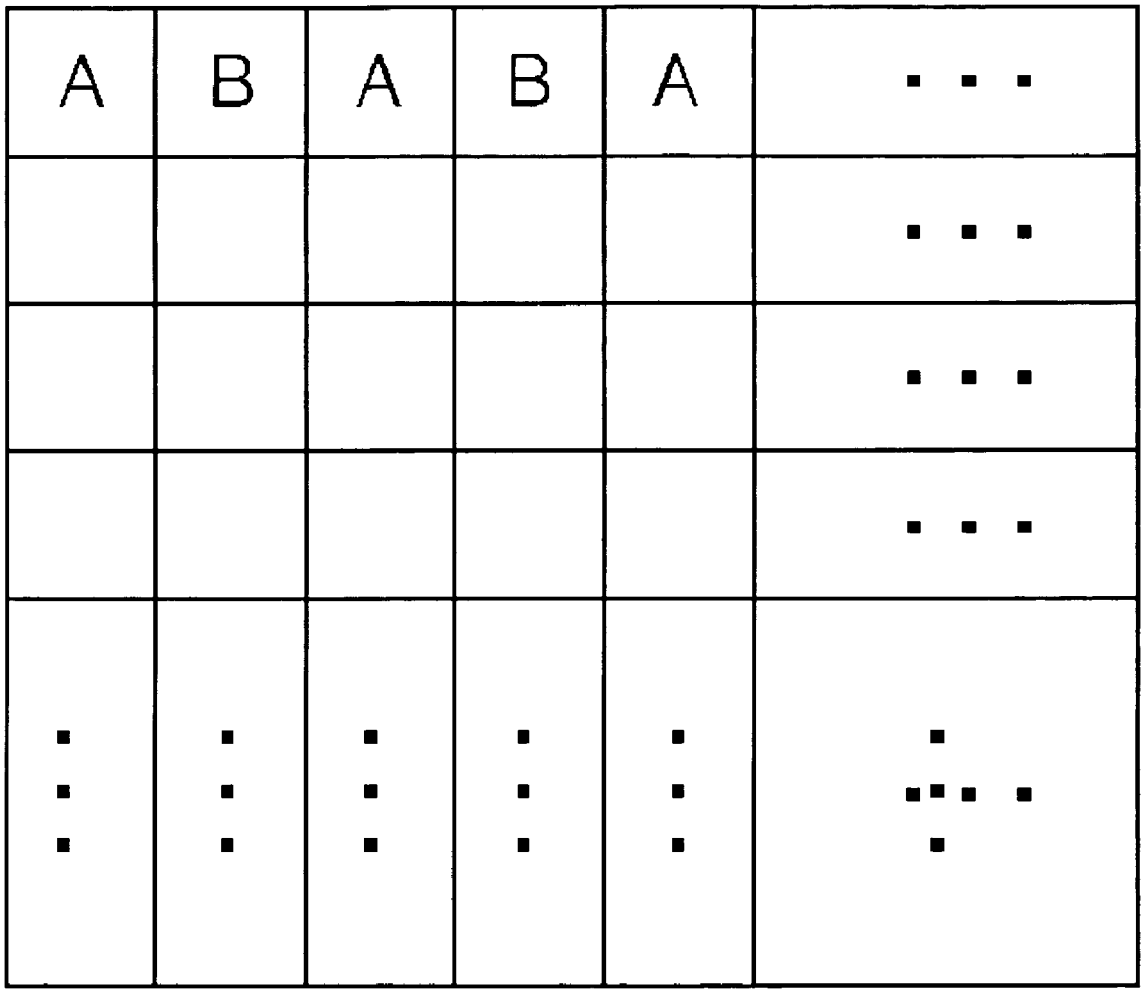
FIG. 3 is a diagram of a method of displaying a gray level having a greatly changeable luminous pattern on the average between adjacent discharge cells.

First of all, the PDP is driven at the normal drive temperature (16~49.9° C.) in the same manner as the related art. In other words, a gray level (16, 32, 64, 128) having a greatly changeable luminous pattern in the same manner of that of the related art PDP is displayed on the average at the normal drive temperature. Namely, by displaying the gray levels of 'A (e.g., 31)' and 'B (e.g., 33)' in the two adjacent discharge cells, as shown in FIG. 3, the gray level of 'C. (e.g., 32) is displayed on the average. Thus, by representing the gray level of which luminous pattern is greatly changed at the normal drive temperature, it is able to display an image of which contour noise is minimized.

Secondly, the entire gray levels are displayed directly when the PDP is driven at low/high temperature (15~(−)50° C./50~100° C.). In other words, the gray level having the greatly changeable luminous pattern is not displayed on the average when the PDP is driven at the low/high temperature. Thus, if the gray level having the greatly changeable luminous pattern is displayed as it is at the low/high temperature, it is able to solve the problem such as flickering mal-discharge, mis-discharge, and the like.

Figure 5:
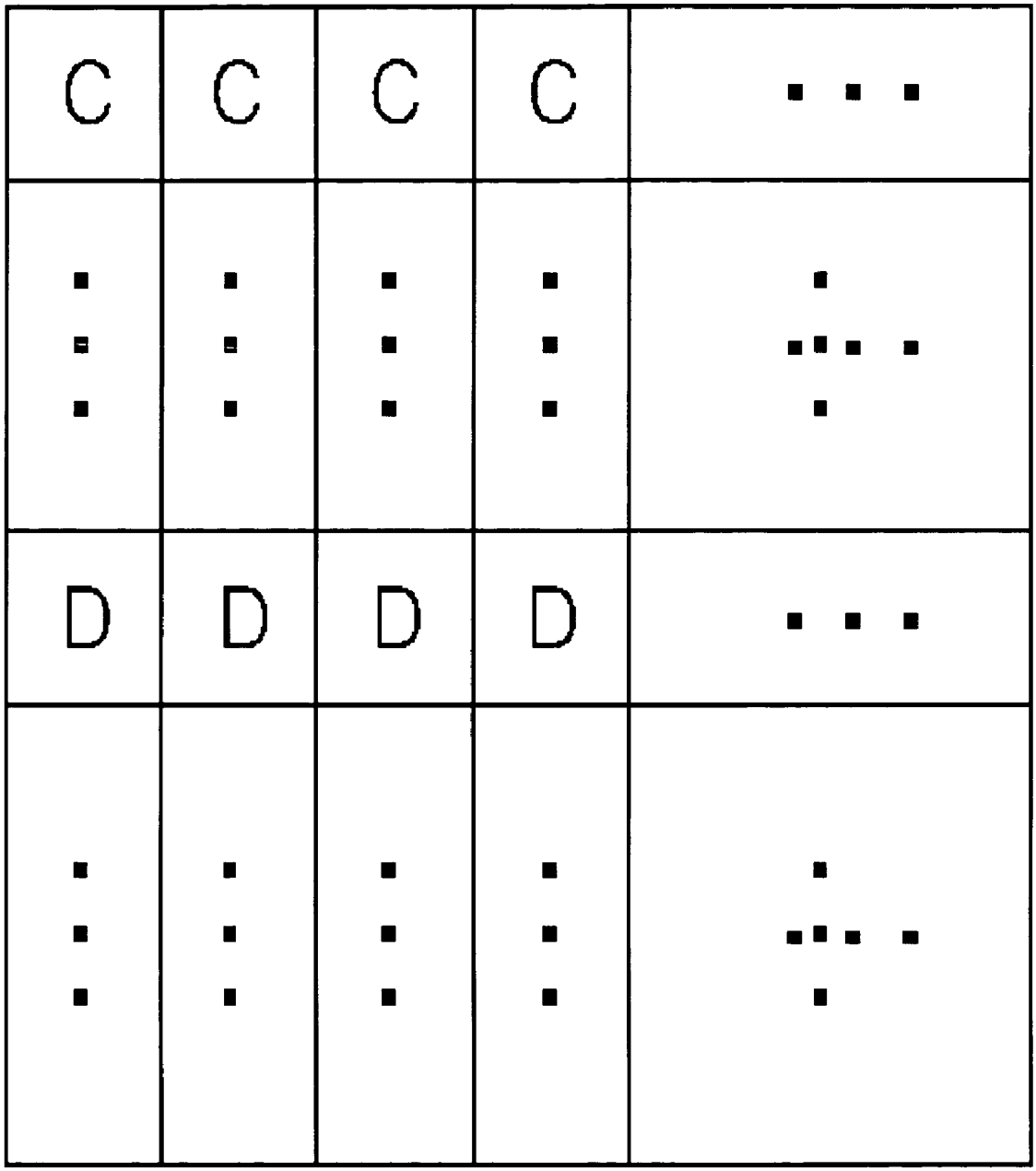
FIG. 5 is a diagram of a method of displaying a gray level having a greatly changeable luminous pattern at high/low temperature according to the driving method shown in FIG. 4.

Specifically, when the PDP is driven at the low/high temperature, the gray level of 'C. (e.g., 32)' or 'D (e.g., 64)' of which luminous pattern is greatly changed, as shown in FIG. 5, is directly displayed in the corresponding discharge cell. In doing so, since the adjacent discharge cells display the identical gray level, the discharges occur at the same time. Thus, if the discharges occur in the adjacent cells at the same time, i.e., if priming charged particles are generated at the same time, a specific discharge cell can be supplied with the priming charged particles supplied from the adjacent discharge cells. Hence, the discharges are facilitated to occur in the discharge cells displaying the same gray level, whereby it is able to prevent the flickering mal-discharge and/or mis-discharge from occurring at the low/high temperature.

Moreover, by applying the present invention to a high-density Xe PDP having a component of Xe amounting to at least 5% of discharge gas sealed within the PDP, it is able to prevent the flickering mal-discharge and/or mis-discharge from occurring when the high-density Xe PDP is driven at the low/high temperature. Namely, in case of applying the present invention to the high-density Xe PDP, it is able to display an image having high brightness without flickering mal-discharge and/or mis-discharge.

Figure 6:
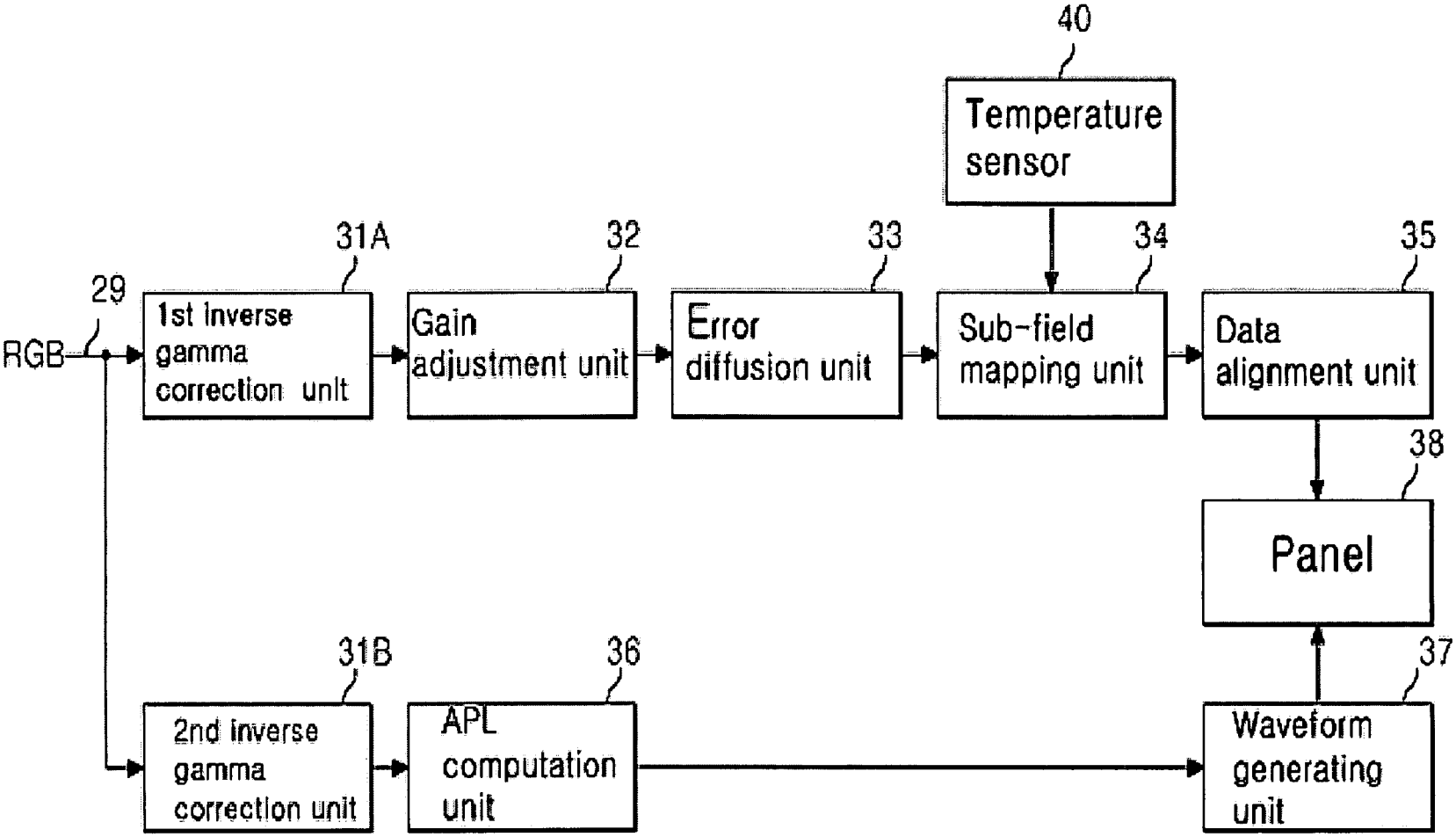
FIG. 6 is a block diagram of an apparatus for driving a plasma display panel according to an embodiment of the present invention.

FIG. 6 is a block diagram of an apparatus for driving a plasma display panel according to an embodiment of the present invention.

Referring to FIG. 6, an apparatus for driving a plasma display panel according to an embodiment of the present invention includes a gain adjustment unit 32 connected between a first inverse gamma correction unit 31A and a data alignment unit 35, an error diffusion unit 33, a sub-field mapping unit 34, an APL computation unit 36 connected between a second inverse gamma correction unit 31B and a waveform generating unit 37, and a temperature sensor 40 connected to the sub-field mapping unit 34.

Each of the first and second inverse gamma correction units 31A and 31B performs inverse gamma correction on digital video data RGB from an input line 29 to linearly convert brightness for a gray level value of a video signal.

The gain adjustment unit 32 adjusts an effective gain per data of red, green, and blue to compensate a color temperature.

The error diffusion unit 33 diffuses a quantization error of the digital video data RGB inputted from the gain adjustment unit 32 into adjacent cells to minutely a brightness value.

The sub-field mapping unit 34 maps the data inputted from the error diffusion unit 33 to a sub-field pattern previously stored per bit and then supplies the mapping data to the data alignment unit 35. A detailed operation of the sub-field mapping unit 34 will be explained later.

The data alignment unit 35 supplies the digital video data inputted from the sub-field mapping unit 34 to a data driving circuit of a panel 38. The data driving circuit, which is connected to data electrodes of the panel 38, latches the data inputted from the data alignment unit 35 by 1-horizontal line and then supplies the latched data to the data electrodes of the panel 38 by 1-horizontal period unit.

The APL computation unit 36 computes an average brightness by one-picture unit, i.e., APL (average picture level), for the digital video data RGB inputted from the second inverse correction unit 31B and then outputs sustain pulse number information corresponding to the computed APL.

The waveform generating unit 37 responds to the sustain pulse number information from the APL computation unit to generate a timing control signal and then supplies the timing control signal to a scan drive circuit and sustain drive circuit (not shown in the drawing). The scan and sustain drive circuits respond to the timing control signal inputted from the waveform generating unit 37 to supply sustain pulses to scan electrodes and sustain electrodes of the panel 38 during a sustain period, respectively.

The temperature sensor 40 detects a drive temperature (peripheral enviroment temperature) of the panel 38 and then supplies a control signal corresponding to the detected drive temperature to the sub-field mapping unit 34.

Operational processes of the temperature sensor 40 and sub-field mapping unit 34 are explained in detail as follows. First of all, the temperature sensor 40 detects the drive temperature (low/high temperature or normal drive temperature) of the panel 38 and then supplies the control signal corresponding to the detected drive temperature to the sub-field mapping unit 34.

The sub-field mapping unit 34 carries out mapping on the sub-field pattern so that a gray level (16, 32, 64, 128), of which luminous pattern is greatly changed, can be displayed on the average when the control signal supplied from the temperature sensor 40 indicates the normal drive temperature. In other words, the sub-field mapping unit 34 displays the gray level, of which luminous pattern is greatly changed, on the average when the panel 38 is driven at the normal drive temperature, thereby enabling display of an image of which contour image is minimized.

In addition, the sub-field mapping unit 34 carries out mapping on the sub-field patterns so that the entire gray levels can be directly displayed when the control signal supplied from the temperature sensor 40 indicates the low/high temperature. In other words, instead of displaying the gray level, of which luminous pattern is greatly changed on the average when the panel 38 is driven at the normal drive temperature, the sub-field mapping unit 34 displays the gray level as it is. Thus, if the gray level, of which luminous pattern is greatly changed at the low/high temperature, is displayed as it is, it is able to solve the problems such as flickering mal-discharge, mis-discharge, and the like.

Accordingly, a method of driving a plasma display panel and apparatus thereof according to the present invention enables the display of an image wherein contour noise is minimized by displaying a gray level, of which luminous pattern is greatly changed, on the average when the plasma display panel is driven at a normal drive temperature, and displaying the entrire gray levels as they are when the plasma display panel is being driven at high/low temperature.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a plasma display panel which includes front and rear substrates confronting each other, a pair of transparent electrodes on a confronting surface of the front substrate, a metal electrode provided to each of the transparent electrodes, a dielectric layer covering the transparent and metal electrodes, a protecting layer coated on the dielectric layer, an address electrode formed on a confronting surface of the rear substrate, a dielectric layer covering the address electrode, a barrier rib formed on the dielectric layer, a discharge cell partitioned by the barrier rib, and a fluorescent layer coated within the discharge cell, the method comprising:

detecting a drive temperature of a panel;

mapping data using a first sub-field pattern when the detected drive temperature of the panel is a low temperature or a high temperature; and mapping the data using a second sub-field pattern different from the first sub-field pattern when the detected drive temperature of the panel is a temperature between the low temperature and the high temperature.

2. The method of claim 1, wherein in displaying a gray level of which luminous pattern is greatly changed, the second sub-field pattern is carried out in a manner of displaying the gray level, of which luminous pattern is greatly changed, on an average in adjacent discharge cells.

3. The method of claim 1, wherein the first sub-field pattern is carried out in a manner of displaying entire gray levels including the gray level, of which luminous pattern is greatly changed.

4. The method of claim 1, wherein the low temperature ranges between 15 ~50° C. and wherein the high temperature ranges between 50~100° C.

5. The method of claim 1, wherein a discharge gas including a Xe gas amounting to at least 5% thereof is provided within an inner space of the panel.

6. An apparatus for driving a plasma display panel which includes front and rear substrates confronting each other, a pair of transparent electrodes on a confronting surface of the front substrate, a metal electrode provided to each of the transparent electrodes, a dielectric layer covering the transparent and metal electrodes, a protecting layer coated on the dielectric layer, an address electrode formed on a confronting surface of the rear substrate, a dielectric layer covering the address electrode, a barrier rib formed on the dielectric layer, a discharge cell partitioned by the barrier rib, and a fluorescent layer coated within the discharge cell, the apparatus comprising:

a temperature sensor detecting a drive temperature of a panel; and a sub-field mapping unit setting up a pattern mapping scheme corresponding to the drive temperature detected by the temperature sensor, the pattern mapping scheme including a first pattern mapping scheme corresponding to a predetermined range of detected drive temperatures and a second pattern mapping scheme corresponding to detected drive temperatures outside the predetermined range, wherein the first pattern mapping scheme is different from the second pattern mapping scheme.

7. The apparatus of claim 6, wherein the sub-field pattern mapping unit carries out the first pattern mapping scheme by mapping data in a manner of displaying entire gray levels including the gray level, of which luminous pattern is greatly changed.

8. The apparatus of claim 6, wherein the sub-field pattern mapping unit carries out the second pattern mapping scheme by mapping data in a manner of displaying the gray level on an average in adjacent discharge cells.

9. The apparatus of claim 6, wherein the low temperature ranges between 15~50° C. and wherein the high temperature ranges between 50~100° C.

10. The apparatus of claim 6, wherein a discharge gas including a Xe gas amounting to at least 5% thereof is provided within an inner space of the panel.

11. A method of driving a plasma display panel, the method comprising:

detecting a temperature of the panel;

generating a control signal based on the detected temperature;

supplying the control signal to a sub-field mapping unit, wherein a first control signal is supplied when the detected temperature is within a predefined range and a second control signal is supplied when the detected temperature is lower than or higher than the predefined range; and mapping a sub-field pattern based on the control signal.

12. The method of claim 11, wherein the predefined range is 15 degrees C. to 50 degrees C.

13. The method of claim 11, wherein:

a first sub-field pattern is mapped if the first control signal is supplied; and a second sub-filed pattern is mapped if the second control signal is supplied.

* * * * *